United States Patent [19]

Horn et al.

[11] Patent Number: 5,051,233

[45] Date of Patent: Sep. 24, 1991

[54] STAINLESS WROUGHT AND CAST MATERIALS AND WELDING ADDITIVES FOR STRUCTURAL UNITS EXPOSED TO HOT, CONCENTRATED SULFURIC ACID

[75] Inventors: Elmar-Manfred Horn, Leverkusen; Stylianos Savakis, Wuerselen, both of Fed. Rep. of Germany

[73] Assignee: Bayer Aktiengesellschaft, Leverkusen, Fed. Rep. of Germany

[21] Appl. No.: 463,689

[22] Filed: Jan. 11, 1990

[30] Foreign Application Priority Data

Jan. 14, 1989 [DE] Fed. Rep. of Germany ..... 3901028

[51] Int. Cl.[5] ..... C22C 38/34

[52] U.S. Cl. ..... 420/50; 420/36; 420/38; 420/117; 420/118; 422/160; 422/161; 423/522

[58] Field of Search ..... 423/522; 422/160, 161; 420/38, 117, 118, 119, 50, 36

[56] References Cited

U.S. PATENT DOCUMENTS

| | | | |
|---|---|---|---|
| 1,420,707 | 6/1922 | Johnson | 420/38 |
| 2,920,954 | 1/1960 | Mott | 75/128 |
| 3,663,215 | 5/1972 | Tanczyn | 420/50 |
| 3,674,468 | 7/1972 | Ota | 420/67 |
| 4,002,510 | 1/1977 | Wilde | 420/50 |
| 4,220,689 | 9/1980 | Schumacher et al. | 420/50 |
| 4,279,648 | 7/1981 | Ito et al. | 420/50 |
| 4,543,244 | 9/1985 | Jones | 423/522 |
| 4,640,817 | 2/1987 | Kajimura et al. | 420/50 |
| 4,653,684 | 3/1987 | Saito et al. | 420/50 |
| 4,671,929 | 6/1987 | Kajimura et al. | 420/50 |
| 4,751,046 | 6/1988 | Simoneau | 420/50 |
| 4,826,655 | 5/1989 | Rundell | 420/50 |
| 4,917,860 | 4/1990 | Culling | 420/50 |

FOREIGN PATENT DOCUMENTS

| | | | |
|---|---|---|---|
| 2040308 | 3/1971 | Fed. Rep. of Germany . | |
| 2324752 | 4/1977 | France . | |
| 0086411 | 7/1975 | Japan | 420/50 |
| 1261809 | 1/1972 | United Kingdom . | |
| 1275007 | 5/1972 | United Kingdom . | |

*Primary Examiner*—Upendra Roy

*Attorney, Agent, or Firm*—Sprung Horn Kramer & Woods

[57] ABSTRACT

In the processing of hot concentrated sulfuric acid or oleum in steel apparatus, the improvement wherein said apparatus is formed of an alloyed material comprising an iron-chrome-nickel-silicon alloy containing 13 to 32% by weight Cr, 5 to 25% by weight nickel and 4 to 9% by weight Si and having a structure containing more than 10% delta-ferrite.

6 Claims, 1 Drawing Sheet

STAINLESS WROUGHT AND CAST MATERIALS AND WELDING ADDITIVES FOR STRUCTURAL UNITS EXPOSED TO HOT, CONCENTRATED SULFURIC ACID

BACKGROUND OF THE INVENTION

1. Field of the Invention

This invention relates to materials which are highly resistant to hot, concentrated sulfuric acid and 0–10% by weight oleum.

2. Description of the Prior Art

The resistance of materials to the corrosive effect of hot, concentrated sulfuric acid is widely discussed in the literature.

On account of the increase in the solubility of lead sulfate with increasing sulfuric acid concentration, lead and its alloys can only be used at $H_2SO_4$ concentrations of up to 78% and at temperatures of only up to 110° C. (Ullmanns Encyclopädie der technischen Chemie, 4th Edition, Vol. 21 (1982), page 157).

Unalloyed steel can be used in 68 to 99% sulfuric acids up to 70° C., although erosion rates of up to 1.3 mm/a can be expected (G. Nelson, Corrosion Data Survey, Shell Development Co., San Francisco, 1950, pp. ZT-102A). In the concentration range of 99 to 100% $H_2SO_4$ there is a considerable reduction in the resistance of unalloyed steel. Relatively high flow rates should be avoided in the case of unalloyed steel ((Ullmann, loc. cit.; Z. f. Werkst.-Techn. 4 (1973), pp. 169/186; R. J. Borges, Corrosion/87, Paper No. 23, NACE, Houston, Tex., 1987).

Cast irons alloyed with chromium or copper are corrosion-resistant in 90 to 99% sulfuric acid at temperatures of up to about 120° C. (Ullmann, loc. cit.), although corrosion is again dependent on the flow rate (Z. f. Werkst.-Techn., loc. cit.). The iron-silicon cast material containing 14 to 18% Si shows very good corrosion resistance in wide concentration and temperature ranges (Ullmann, loc. cit.); however, a major disadvantage of this special cast iron is that it is hard and brittle (R. J. Borges, Corrosion/87, loc. cit.; Ullmann, 4th Edition, Vol. 3 (1973), page 21). Stainless austenitic standard steels, for example Werkst.-Nr. (material No.) 1.4571, are used in concentrated sulfuric acids up to temperatures of 85° C. The erosion rates increase steeply with increasing temperature. Erosion rates of the order of 1 mm/a can be expected at only 150° C. (Z. f. Werkst.-Techn. 8 (1977), pp. 362/370 and 410/417), corrosion again showing pronounced dependence on the flow rate.

The use of nickel base alloys does not afford any advantages. In plate-type heat exchangers of NiMo16Cr15W, Werkst-Nr. (material No.) 2.4819 (type Hastelloy alloy C-276), which are used for cooling concentrated sulfuric acid, the product temperature is limited to 95° C. (N. Sridhar, Materials Performance, March 1988, pp. 40/46).

Accordingly, there has been no shortage of proposals to improve resistance to sulfuric acid by alloying measures. Thus, the stainless austenitic steel X 1 CrNiSi 18 15 containing 3.7 to 4.3% Si, Werkst.-Nr. (material No.) 1.4361, shows considerably higher resistance than Werks.-Nr. (material No.) 1.4571 in, for example, 98.5% sulfuric acid at 150° to 200° C. (Ullmann, Vol. 3, page 21); the dependence of corrosion on the flow rate is very low (Z. f. Werkst. Techn. 8 (1977), pp. 362/370 and 410/417; M. Renner and R. Kirchheiner, "Korrosionbeständigkeit von hochlegierten nichtrostenden Sonderstählen in stark oxidierenden Medien (Corrosion resistance of highly alloyed stainless special steels in highly oxidizing media)". Paper presented at the Seminar "Nickelwerkstoffe und hochlegierte Sonderstähle (Nickel materials and highly alloyed special steels)", Esslingen, 7th/8th Apr., 1986). The corrosion resistance of austenitic stainless steels in hot 85%, preferably 90%, sulfuric acids can be improved within certain limits by further increasing the Si content to 4.5 to 5.8% (U.S. Pat. No. 4,543,244; DE-OS 33 20 527). On account of the pronounced dependence of corrosion on temperature, however, a special steel such as this would be unsuitable for use at relatively high temperatures. The following erosion rates were determined for a fully austenitic stainless steel having the composition 17.5% Cr, 17.5% Ni, 5.3% Si, rest essentially iron, in 98.2% sulfuric acid (cf. U.S. Pat. No. 4,543,244 and DE-OS 33 20 527):

125° C.—0.1 mm/a
135° C.—0.8 mm/a
145° C.—1.6 mm/a;

a corrosion rate of 0.25 mm/a was determined in 93.5% $H_2SO_4$ at 85° C. To reduce corrosion, the plants could be given anodic protection. Under these conditions, however, the erosion rate in 93.5% $H_2SO_4$ at 200° C. is still 1.1 mm/a.

In addition, hardenable nickel base alloys containing 2 to 4% Si have been proposed for handling hot, at least 65% sulfuric acid (DE-PS 21 54 126). However, the erosion rates in sulfuric acid heated to 120° C. of approximately 0.6 mm/a are extremely high. Erosion rates of 0.25 mm/a in 98% $H_2SO_4$ heated to 140° C. are cited for another hardenable nickel base alloy unaffected by flow (R. J. Borges, Corrosion/87, loc. cit.).

By contrast, an austenitic stainless steel containing 17% Cr, 16% Ni, 3.7% Si and 2.3% Mo can only be used in cold sulfuric acids at concentrations below 10% and above 80% (Publication No. 235 of the CAFL: Uranus, rost- und säurebeständige Stähle für schwierige Korrosionsprobleme (Uranus, stainless acid-resistant steels for difficult corrosion problems), p. 37). According to GB-PS 1,534,926, austenitic chrome-nickel-copper steels optionally alloyed with molybdenum must contain at least 4.1% or 4.7% silicon to guarantee high resistance to corrosion in 96.5% $H_2SO_4$ heated to 110° C. The same applies to iron-chrome-nickel-cobalt-silicon alloys in 99% $H_2SO_4$ heated to 130° C. (N. Sridhar, loc. cit.).

Finally, iron-chrome-nickel alloys containing 4 to 6% silicon have been described in the literature, their delta-ferrite content being limited to 5 to 10% so that no coherent delta-ferrite network can be formed (D. J. Chronister and T. C. Spence, Corrosion 85, Paper 305, NACE, Boston/Mass., March 1985). A network such as this can be expected beyond delta-ferrite contents of 10%. The erosion rates of an alloy containing 4.8% Si described by D. J. Chronister et al. in 95% $H_2SO_4$ heated to 110° C. are initially relatively low (0.4 mm/a), but increase rapidly to 2.4 mm/a in the event of prolonged exposure. Alloys containing 5 to 5.2% Si showed corrosion rates of 0.11 to 0.56 mm/a under these conditions. Erosion rates of the order of 0.1 mm/a are only observed at an Si content of 5.6%. However, if the temperature of the 95% $H_2SO_4$ is increased to 130° C., increasing erosion rates of 0.6 mm/a in the first test phase (48 h) and of as high as 1.24 mm/a in the second phase are again observed at an Si content of 5.6%. At an Si content of 5.9%, the erosion rates reach 0.45 to 0.54 mm/a.

SUMMARY OF THE INVENTION

It has now been found that the corrosion resistance of silicon-containing iron-chrome-nickel alloys in hot, more than 75% sulfuric acids or 0–10% by weight oleum can be considerably improved by establishing an alloy structure containing more than 10% delta-ferrite.

Accordingly, the invention relates to stainless wrought and cast materials and also welding additives for structural units—exposed to hot, concentrated sulfuric acid or 0–10% by weight oleum—of iron-chrome-nickel-silicon alloys containing 13 to 32% by weight Cr, 5 to 25% by weight Ni and 4 to 9% by weight Si and having a structure containing more than 10% delta-ferrite.

The Si content is 4 to 9% by weight and preferably 4.3 to 7.5% by weight.

The Cr content is 13 to 32% by weight and preferably 15 to 24% by weight.

The Ni content is 5 to 25% by weight and preferably 10 to 23% by weight. Part of the nickel, for example 1 to 80%, may be replaced by cobalt.

The balance to 100% by weight consists of iron and the unavoidable accompanying elements, such as carbon and/or sulfur and/or phosphorus. In addition to the alloying constituents mentioned and the unavoidable accompanying elements, the materials according to the invention may also contain one or more of the elements manganese, molybdenum, copper, silver, cobalt, tungsten, niobium, tantalum and nitrogen, preferably manganese, molybdenum, copper, silver, cobalt and nitrogen. The content of these elements is limited to the following percentages by weight; Mn 8%, Mo 3%, Cu 4%, Ag 2%, Co 20%, W 4%, Nb/Ta together 2% and N 0.2%.

Contrary to the teaching of the prior art, the wrought and cast materials and welding additives according to the invention are characterized by a delta-ferrite content of more than 10%. The delta-ferrite content is preferably between 10 and 65% and, more preferably, between 11 and 55%. The delta-ferrite content derives from the ratio of chrome equivalent (alloying elements Cr, Si, Mo, W) to nickel equivalent (alloying elements Ni, Co, C, N, Mn, Cu), a different valency or weighting being attributed to the individual alloying elements. This correlation is known in principle to the expert.

The materials having the above-mentioned composition are preferably heat-treated (solution-heat-treated), for example at 1030°–1250° C., before use.

The materials according to the invention are highly resistant to corrosion in more than 75% $H_2SO_4$ preferably 85 to 100% $H_2SO_4$ and, more preferably, 90 to 100% $H_2SO_4$ and in oleum of 0–10% by weight. They show this high resistance to corrosion at high temperatures, for example at 90° to 350° C., preferably at 150° to 340° C. and, more preferably, at 200° C. to the boiling point of the highly concentrated sulfuric acids or oleum. Often the materials or the structural units made thereof are used at temperatures of 180°–335° C. Accordingly, the materials according to the invention may be used for structural units exposed to such hot, concentrated sulfuric acids. The materials or structural units are exposed to hot concentrated sulfuric acid or oleum of 0–10% by weight at a pressure of 0.1 bar to 10 bar. Structural units such as these include, for example, reaction vessels, pumps, fittings, pipes, heat exchangers, etc. Structural units such as these may be made by forging and rolling (milling), by casting, by lining, by plating, by shaping welding or by structural welding. Those structural units are used for example in the upgrading of sulfuric acid.

In the context of the invention, high corrosion resistance are surprising because, according to D. J. Chronister (loc. cit.), the delta-ferrite content of iron-chrome-nickel-silicon alloys should be limited to between 5 and at most 10% for reasons of corrosion. In addition to the observed corrosion resistance, however, an increased delta-ferrite content has the advantage of facilitating the welding, such as the assembly welding or joining, of castings and of distinctly improving the resistance of the materials to erosion.

BRIEF DESCRIPTION OF THE DRAWINGS

The invention will be further described in the following examples in conjunction with the accompanying drawings where.

EXAMPLES

Description of the Preferred Embodiments

Materials I to XX according to the invention were made, being characterized by the properties shown in Table 2. The elastic limit $R_{p0.2}$ is the stress up to a non-proportional elongation of 0.2% (tensile test according to DIN 50 145), the tensile strength $R_m$ is the stress arising out of the maximum force based on the initial cross-section, the elongation at break $A_5$ is the permanent change in length, based on the initial measured length, after breakage of the test specimen and the impact energy $A_v$ is the impact energy absorbed by ISO-V test specimens, as measured in J (notched impact bending test according to DIN 50 115).

Figure 1:
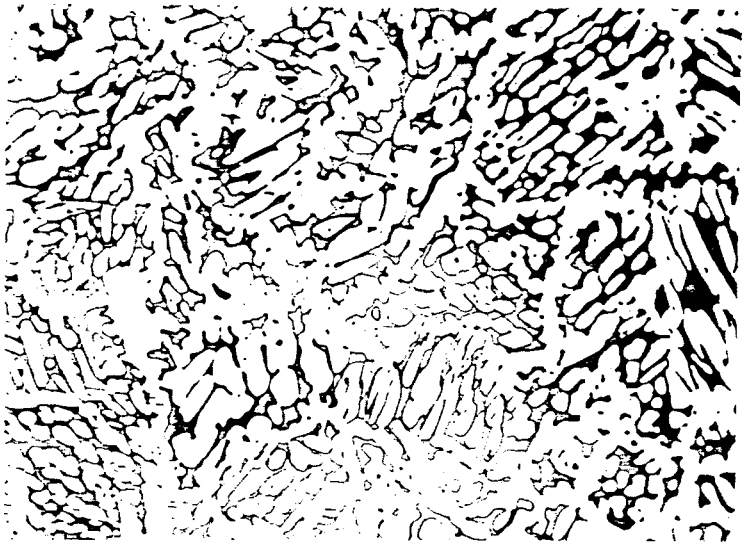
FIGS. 1 to 3 are metallographic microsections of etched materials in accordance with the present invention.
Figure 2:
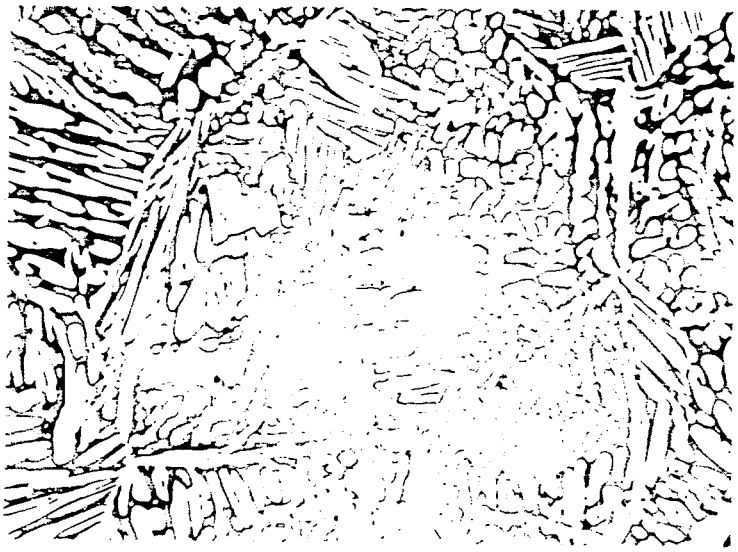
Figure 3:
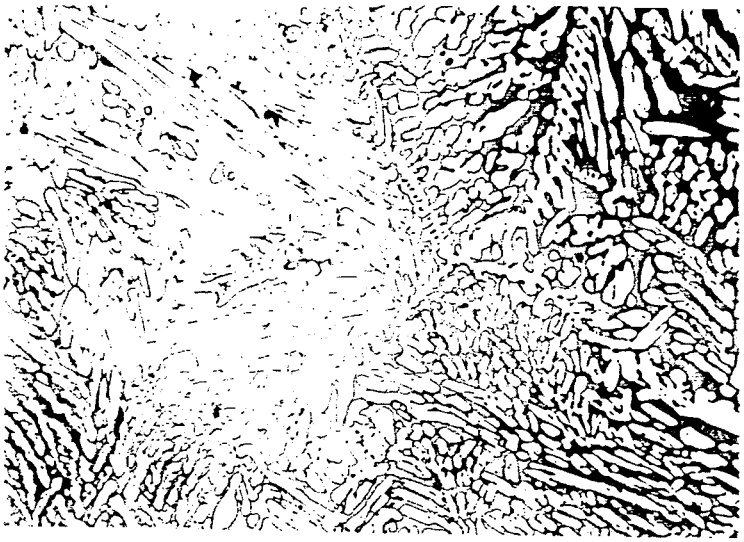

Metallographic microsections of materials IV, V and VI etched by the Murakami method are shown by way of Example in FIGS. 1, 2 and 3 (magnification 50:1), from which the structure can be seen. The Murakami etching reagent (10 g $K_3[Fe(CN)_6]$, 10 g KOH and 100 g $H_2O$) shows up the delta-ferrite darker than the austenite.

Materials I to X were subjected to various corrosion tests over a period of 360 to 670 h. The various corrosion tests were carried out in boiling 93.3% $H_2SO_4$ (297° C.), boiling 95.3% $H_2SO_4$ (313° C.), boiling 96.6% $H_2SO_4$ (316° C) and boiling 98.2% $H_2SO_4$ (334° C.)

Table 3 shows the corrosion rates determined.

Further results of corrosion tests with materials IV to IX and XI to XII in sulfuric acid regenerating plants are shown in Table 4.

TABLE 1

| | Chemical composition of the materials tested contents in % by weight (balance to 100% is Fe) | | | | | | | | | | |
|---|---|---|---|---|---|---|---|---|---|---|---|
| Material | C | Si | Mn | Cr | Ni | Co | Cu | Mo | P | S | Others |
| I | 0.029 | 4.62 | 4.35 | 20.64 | 12.83 | | | 0.04 | 0.016 | 0.005 | N: 0.093 |
| II | 0.031 | 5.57 | 4.27 | 17.40 | 13.16 | | | 0.02 | | 0.04 | N: 0.04 |
| III | 0.023 | 6.49 | 4.20 | 15.43 | 13.54 | | | 0.02 | | 0.04 | N: 0.031 |

TABLE 1-continued

| Material | C | Si | Mn | Cr | Ni | Co | Cu | Mo | P | S | Others |
|---|---|---|---|---|---|---|---|---|---|---|---|
| | | Chemical composition of the materials tested contents in % by weight (balance to 100% is Fe) | | | | | | | | | |
| IV | 0.027 | 4.76 | 0.94 | 21.08 | 13.06 | | 0.05 | 0.02 | 0.009 | 0.01 | N: 0.084 |
| V | 0.024 | 5.09 | 1.0 | 18.50 | 9.30 | 4.0 | | 0.04 | 0.011 | 0.008 | N: 0.061 |
| VI | 0.025 | 5.23 | 1.01 | 22.35 | 8.30 | 9.20 | | 0.04 | 0.012 | 0.009 | |
| VII | 0.03 | 5.45 | 4.35 | 21.10 | 10.85 | 5.10 | 2.24 | | | | |
| VIII | 0.03 | 5.30 | 2.69 | 18.10 | 11.20 | | 0.44 | 0.93 | 0.019 | 0.012 | W: 0.42<br>Nb: 0.42 |
| IX | 0.03 | 6.45 | 1.03 | 21.10 | 12.30 | 7.10 | | | | | |
| X | 0.011 | 5.1 | 0.01 | 19.3 | 11.2 | 11.8 | 2.2 | 1.5 | | | |
| XI | 0.034 | 5.0 | 0.44 | 22.2 | 9.1 | 10.0 | 2.9 | | 0.006 | 0.004 | N: 0.08 |
| XII | 0.04 | 5.2 | 0.48 | 20.2 | 9.2 | 9.2 | 1.1 | | 0.008 | 0.009 | N: 0.07 |
| XIII | 0.033 | 5.5 | 0.16 | 21.4 | 9.29 | 9.25 | 1.28 | | | | |
| XIV | 0.029 | 5.65 | 0.12 | 15.25 | 4.37 | 10.65 | | | | | |
| XV | 0.032 | 5.15 | 0.13 | 22.35 | 3.46 | 20.65 | | | | | |
| XVI | 0.026 | 5.29 | 0.66 | 20.53 | 13.24 | | | | | | N: 0.034 |
| XVII | 0.017 | 5.0 | 0.08 | 22.9 | 10.8 | 8.4 | 4.26 | | 0.004 | 0.006 | N: 0.064 |
| XVIII | 0.027 | 5.18 | 0.08 | 22.4 | 10.9 | 7.1 | 4.28 | | 0.004 | 0.005 | N: 0.09<br>Ag: 0.03 |
| XIX | 0.022 | 5.16 | 0.05 | 17.7 | 10.9 | 8.0 | 4.19 | 1.62 | 0.004 | 0.006 | N: 0.084 |
| XX | 0.07 | 5.20 | 0.06 | 20.0 | 13.8 | 11.2 | 2.2 | 2.5 | 0.005 | <0.001 | N: 0.005 |

TABLE 2

| Material | Heat treatment | $R_{p0.2}$ N/mm² | $R_m$ N/mm² | $A_5$ % | $A_v$ J | Delta-ferrite % |
|---|---|---|---|---|---|---|
| | Mechanical properties, ferrite content and heat treatment of the test materials | | | | | |
| I | 1070° C./W | 360 | 695 | 44.9 | 135 | 15 |
| II | 1120° C./W | 403 | 778 | 41.0 | 118 | 19 |
| III | 1120° C./W | | | | | 45 |
| IV | 1100° C./W | 436 | 803 | 41 | 107 | 23 |
| V | 1100° C./W | 466 | 840 | 40 | 129 | 26 |
| VI | 1100° C./W | 527 | 848 | 23.7 | 51 | 36 |
| VII | 1100° C./W | 515 | 770 | 10.0 | 18 | 43 |
| VIII | 1100° C./W | | | | | 53 |
| IX | 1100° C./W | | | | | 28 |
| X | 1070° C./W | | | | | 20 |
| XI | 1100° C./W | 405 | 780 | 18.5 | 56 | 20 |
| XII | 1100° C./W | 370 | 720 | 27.0 | 196 | 13 |
| XIII | 1100° C./W | 450 | 815 | 40.2 | 53 | 15 |
| XVI | 1100° C./W | | | | | 20 |
| XV | 1100° C./W | 444 | 896 | 41.9 | 22 | 44 |
| XVI | 1100° C./W | 427 | 782 | 36.0 | 143 | 28 |
| XVII | 1100° C./W | 466 | 840 | 37.5 | 82 | 25 |
| XVIII | 1100° C./W | 460 | 752 | 16.8 | 39 | 28 |
| XIX | 1100° C./W | | | | | 27 |
| XX | 1100° C./W | | | | | 16 |

TABLE 3

| Material | 93.3% | 95.3% | 96.6% | 98.2% |
|---|---|---|---|---|
| | Erosion rates (mm/a) of the heat-treated materials in highly concentrated, boiling sulfuric acids of different concentration (% by weight) | | | |
| I | 0.9[1] | 0.7[1] | 0.6[3] | 0.2 |
| II | 0.6[1] | 0.4[1] | 0.25[3] | 0.1 |
| III | 0.55[1] | 0.4[1] | 0.25[3] | 0.1 |
| IV | 0.3 | 0.15 | 0.2 | <0.1 |
| V | 0.3 | 0.15 | 0.2 | 0.1 |
| VI | 0.4 | 0.2 | 0.2 | 0.1 |
| VII | (0.9)[2] | (0.4)[2] | | |
| VII | 0.45 | 0.3 | 0.25 | 0.1 |
| VIII | (0.85)[2] | (0.4)[2] | | |
| VIII | 0.45 | 0.3 | 0.25 | 0.15 |
| IX | 0.45 | 0.3 | | 0.15[3] |
| X | 0.4 | 0.35 | 0.27 | 0.15 |

The erosion rates in brackets were determined on non-heat-treated materials.
Test duration:
[1]360 h
[2]410 h
[3]530 h
Rest: 670 h

TABLE 4

| Materials | 96% $H_2SO_4$ 330° C./59 d | 93% $H_2SO_4$ 180° C./231 d |
|---|---|---|
| | Results of in-plant corrosion tests in sulfuric acid regenerating plants Erosion rates in mm/a | |
| IV | 0.12 | 0.07 |
| V | 0.12 | 0.03 |
| VI | 0.14 | 0.04 |
| VII | 0.1 | 0.08 |
| VIII | 0.13 | 0.11 |
| IX | 0.04 | 0.03 |
| XI | 0.14 | |
| XII | 0.16 | |

It is understood that the specification and examples are illustrative but not limitative of the present invention and that other embodiments within the spirit and scope of the invention will suggest themselves to those skilled in the art.

What is claimed is:

1. Stainless wrought and cast materials and welding additives for structural units resistant to hot concentrated sulfuric acid or oleum of 0–10% by weight, comprising an iron-chrome-nickel-silicon alloy containing 13 to 32% by weight Cr, 5 to 25% by weight nickel and 4 to 9% by weight Si and having a structure containing more than 10% delta-ferrite, wherein the material or additive at most contains the following percentages by weight of the indicated component: Mn 8%, Mo 3%, Cu 4%, Ag 2%, Co 20%, W 4%, Nb/Ta together 2% and N 0.2%.

2. A material according to claim 1, having a delta-ferrite content of 10 to 65%.

3. A material according to claim 1, having a delta-ferrite content of 11 to 55%.

4. A material according to claim 1, containing at least one of the elements manganese, molybdenum, copper, silver, cobalt, tungsten, niobium, tantalum and nitrogen, and optionally containing at least one of carbon, sulfur and phosphorus.

5. A material according to claim 1, containing at least one of the elements manganese, molybdenum, copper, silver, cobalt and nitrogen.

6. A material according to claim 1, which has been heat treated at 1030°–1250° C.

* * * * *